US005930958A

United States Patent [19]

Stanley

[11] Patent Number: 5,930,958

[45] Date of Patent: Aug. 3, 1999

[54] INSULATED CONCRETE FORM SYSTEM

[75] Inventor: Elmer Gene Stanley, Fort Worth, Tex.

[73] Assignee: Starfoam Manufacturing Inc., San Antonio, Tex.

[21] Appl. No.: 08/915,291

[22] Filed: Aug. 20, 1997

[51] Int. Cl.[6] ..... E04B 2/86; E04C 1/00; E04G 21/14

[52] U.S. Cl. ..... 52/98; 52/284; 52/439; 52/590.2; 52/592.3; 52/606; 52/745.1; 52/747.1

[58] Field of Search ..... 52/439, 284, 286, 52/590.1, 590.2, 592.2, 592.3, 606, 745.09, 745.1, 747.1, 98, 100

[56] References Cited

U.S. PATENT DOCUMENTS

| | | | |
|---|---|---|---|
| 748,603 | 1/1904 | Henry | 52/590.1 |
| 789,731 | 5/1905 | Hinton | 52/100 |
| 1,166,405 | 12/1915 | Ayer et al. | 52/606 |
| 1,395,176 | 10/1921 | Close | 52/100 |
| 2,681,561 | 6/1954 | Rees | 52/439 |
| 3,410,044 | 11/1968 | Moog | 52/439 |
| 3,906,665 | 9/1975 | Medlin | 52/590.1 |
| 4,597,236 | 7/1986 | Braxton | 52/606 |

FOREIGN PATENT DOCUMENTS

| | | | |
|---|---|---|---|
| 229611 | 4/1959 | Australia | 52/590.2 |
| 537950 | 5/1955 | Belgium | 52/592.3 |
| 808379 | 7/1951 | Germany | 52/100 |
| 2435139 | 2/1975 | Germany | 52/100 |
| 287144 | 3/1953 | Switzerland | 52/439 |
| 459516 | 9/1968 | Switzerland | 52/100 |

*Primary Examiner*—Michael Safavi
*Attorney, Agent, or Firm*—Christopher L. Makay

[57] ABSTRACT

An insulated concrete form system for constructing the walls of a structure including a multiplicity of insulated concrete form units. Each insulated concrete form unit includes a body, a tenon and a mortise positioned at opposing ends of the body, and at least one opening extending substantially vertically through the body. Each insulated concrete form unit may further include at least one cavity extending through the body for receiving concrete. Each insulated concrete form unit is stacked vertically on one another to form a column. Thus, an insulated form system features a series of adjacent columns that are joined together to form the walls of a desired structure. In particular, adjacent columns are joined by offsetting the vertical height of one column relative to an adjoining column. Accordingly, each mortise and tenon from one insulated concrete form unit of one column joins in an offset manner with the mortises and tenons of at least two concrete form units from an adjacent column.

16 Claims, 4 Drawing Sheets

INSULATED CONCRETE FORM SYSTEM

BACKGROUND OF THE INVENTION

1. Field of the Invention

The present invention relates to building materials, and more particularly, but not by way of limitation, to an insulated concrete form system for constructing the walls of a structure.

2. Description of the Related Art

One construction building material is known as an insulated concrete form (ICF). Typically, an ICF is constructed from expanded polystyrene and has a rectangular shape. ICFs are popular due to their low cost and low flammability as compared to other plastic building materials.

During construction, two ICFs are positioned end-to-end and connected. Subsequent ICFs are connected to an unconnected end of a connected ICF to form a row. After the first row is created, subsequent ICFs are connected and positioned on top of the first row to form a second row. Subsequent rows of ICFs are added until the ICFs extend to the desired height of a wall. Once the wall is established, concrete is poured to reinforce the ICFs.

One such ICF is disclosed in U.S. Pat. No. 4,894,969 issued Jan. 23, 1990, to Horobin. Horobin discloses a polystyrene building block that has rails on a top side and grooves on a bottom side for facilitating the stacking of a plurality of blocks. The blocks also have grooves for facilitating the cutting of the block's body into smaller block components. The blocks and/or components are employed to form building wall structures.

Another building block design is disclosed in U.S. Pat. No. 3,292,331 issued Dec. 20, 1966, to Sams. Sams discloses a polymeric-material block having T-shaped slots at opposing ends. A substantially I-shaped key inserts into adjacent slots to fasten a plurality of blocks together.

These building block designs suffer several disadvantages. Horobin patent requires additional stabilizing after the ICFs are positioned for reinforcement with concrete. When reinforcing these walls, the walls must withstand the weight of the concrete. Individual rows of ICFs may shift or topple during concrete reinforcement. As a result, the erected ICFs must be substantially braced prior to the concrete pour.

The Sams building block could not be manufactured from expanded polystyrene because the cored passage that receives concrete is too small to properly stabilize an ICF wall with concrete. In addition, this building block design lacks the versatility for constructing a building. Buildings often contain oddly shaped and angled walls. The Sams building block does not provide a mechanism for easily reshaping the block to meet the design specifications of the building.

Accordingly, an ICF system that forms a unitary, stabilized wall reenforceable with concrete without substantial bracing and is easily modifiable to construct various sizes and shapes of building walls will improve over conventional ICF systems.

SUMMARY OF THE INVENTION

In accordance with the present invention, an insulated concrete form unit includes a body, and at least one opening extending substantially vertically through the body. The tenon and mortise are positioned at opposing ends of the body. The opening is for facilitating the cutting of the body into at least two smaller component bodies, whereby from each opening a mortise is formed on one component body.

Additionally, the insulated concrete form system may further include at least one cavity extending through the body. The cavity is for receiving reinforcing concrete.

Another embodiment of the present invention is an insulated concrete form system that includes a first unit having a first height positioned to create a first column of units. A second unit is coupled to the first unit and has a second height unequal to the first height, thereby creating a second column of units horizontally offset from the first column of units.

A further embodiment of the present invention is a method of creating an insulated concrete form wall. The method includes the steps of positioning a first main unit, cutting a second main unit to a height that horizontally offsets its top surface with a top surface of the first unit, and coupling the first and second units together. The main unit includes a substantially rectangular body, a tenon, a mortise, three trapezoidal openings, and four substantially circular cavities. The tenon and mortise are positioned at opposing ends of the body. The trapezodial openings and substantially circular cavities extend through the body.

It is, therefore, an object of the present invention to provide an ICF system that allows concrete reinforcement without substantial bracing of the ICF wall.

Another object of the present invention is to provide ICF system that permits flexibility for creating walls of various shapes and sizes.

DETAILED DESCRIPTION OF THE PREFERRED EMBODIMENT

Figure 1:
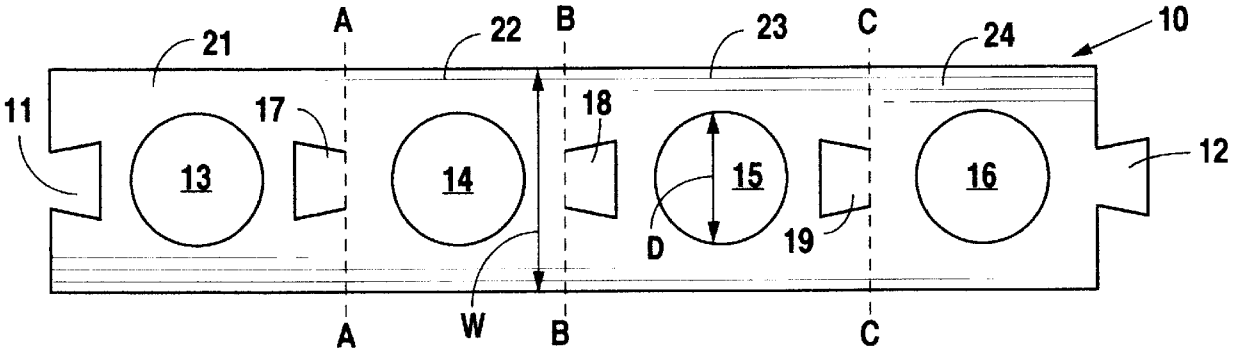
FIG. 1 is a top, plan view of a main unit according to the preferred embodiment.
Figure 2:
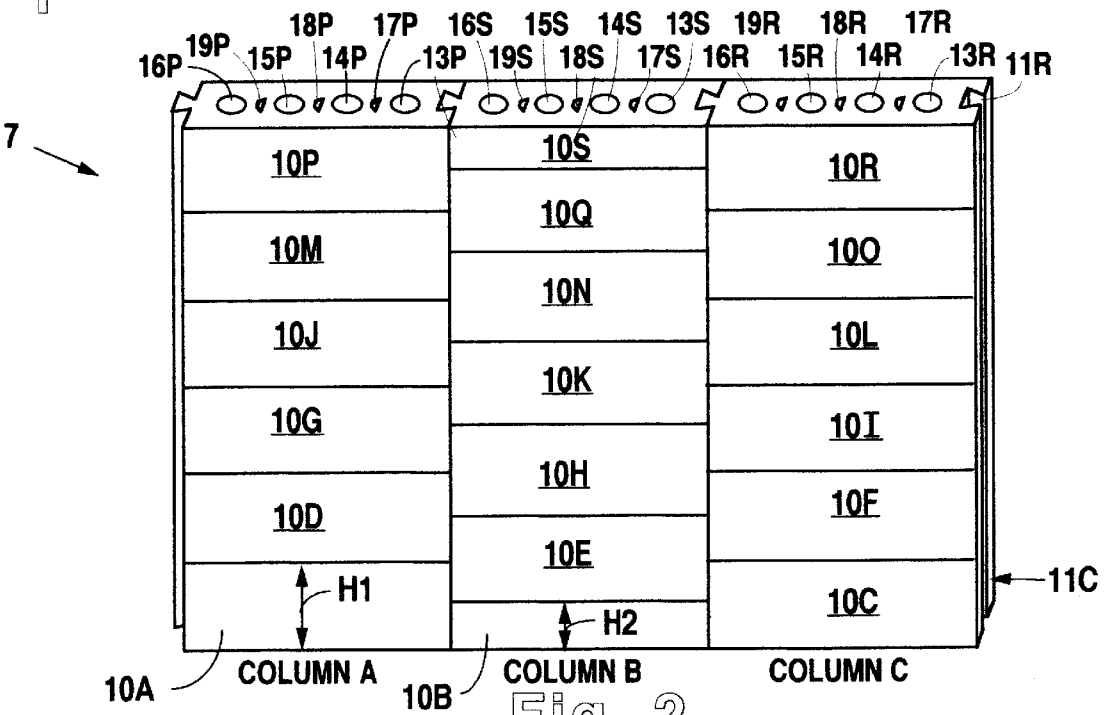
FIG. 2 is a perspective view of a wall created using the ICF system.
Figure 3:
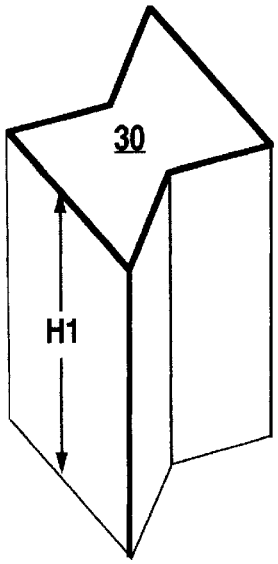
FIG. 3 is a perspective view of a key unit according to the preferred embodiment.
Figure 5:
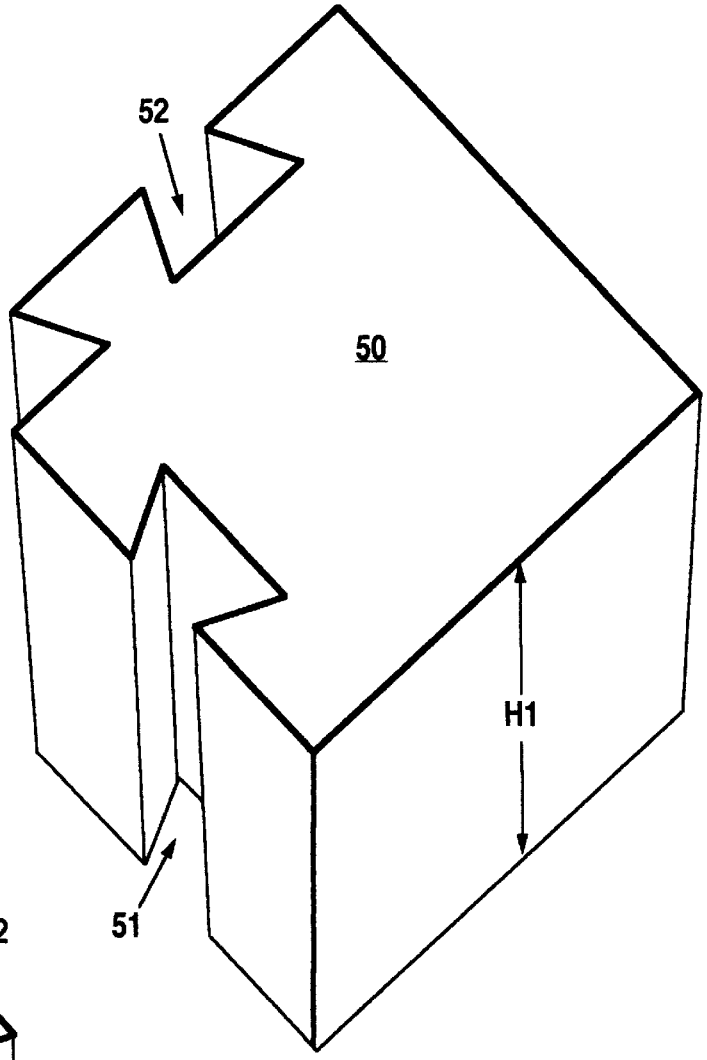
FIG. 5 is a perspective view of a corner joint according to the preferred embodiment.
Figure 4:
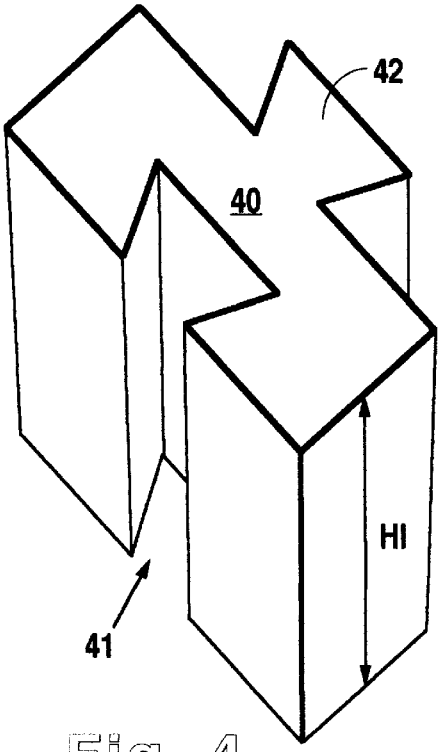
FIG. 4 is a perspective view of an extension unit according to the preferred embodiment.
Figure 6:
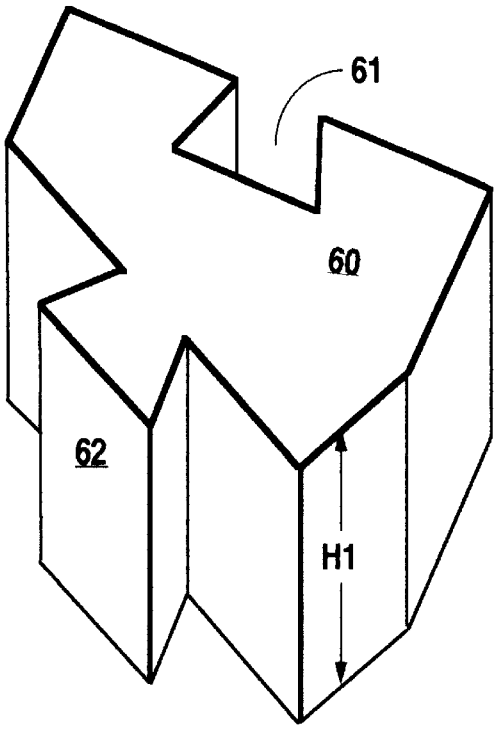
FIG. 6 is a perspective view of an angled unit according to the preferred embodiment.

As illustrated in FIGS. 1–2, a main unit 10 of the preferred embodiment is preferably constructed from expanded polystyrene having a height, a width, and a length. Each main unit 10 includes a mortise 11, a tenon 12, a first cavity 13, a second cavity 14, a third cavity 15, a fourth cavity 16, a first opening 17, a second opening 18, and a third opening 19. The mortise 11 and tenon 12 receive the respective tenon or mortise of an adjoining unit for forming a row. Preferably, cavities 13, 14, 15, and 16 are substantially circular-shaped and have a diameter D that is greater than one-half the width W of the main unit 10 for receiving sufficient concrete to reinforce an ICF wall (described herein). Key openings 17, 18, and 19 are substantially trapezoidal shaped and serve two purposes. They may serve as a mortise to a component unit or may be grouted with concrete prior to pouring concrete into cavities 13–16 for stabilizing an ICF wall (described herein). The main unit has a height H1, but may be cut with a hot wire cutting device to a height H2 for constructing an ICF wall (described herein).

For creating additional units, the main unit 10 may be subdivided into component units 21–24. A hot wire cutting device cuts along lines A—A, B—B, and C—C to create component units 21–24. Cutting along these lines creates two double female units 21 and 23, an end unit 24, and a column unit 22. In addition to these units 21–24, it should be readily understood that other component units may be created by cutting along one or two of the lines A—A, B—B, or C—C.

These component units may be combined with other units as illustrated in FIGS. 3–10. These units include a key unit 30, an extension unit 40, a corner unit 50 and an angled unit 60. The units 40, 50, and 60 are preferably constructed of expanded polystyrene and have a height H1. Although exemplary combinations of units 10, 30, 40, 50, and 60 are illustrated in FIGS. 7–10, it should be readily understood that other combinations of units 10, 30, 40, 50, and 60 may be made.

Figure 7:
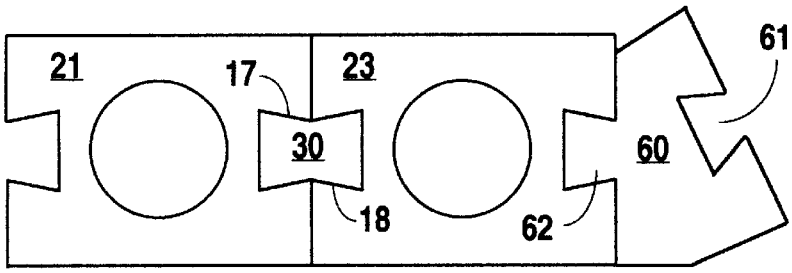
FIG. 7 is a top plan view of an angled unit and key unit in combination with two component units.

The key unit 30 secures a two units having mortises abutting one another. As illustrated in FIG. 7, the unit 30 inserts into the mortise 17 of the unit 21 and the mortise 18 of the unit 23 for joining the units 21 and 23 together.

Figure 8:
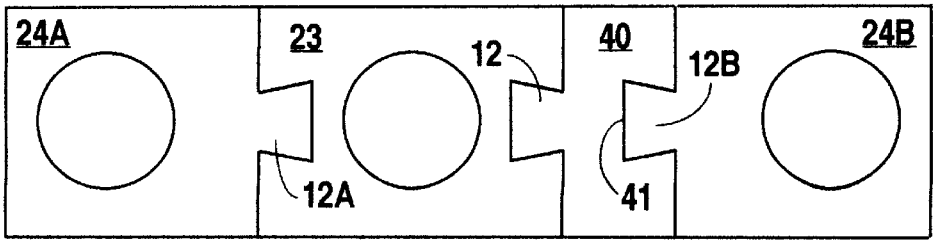
FIG. 8 is a top plan view of a key unit and an extension unit in combination with three component units.
Figure 10:
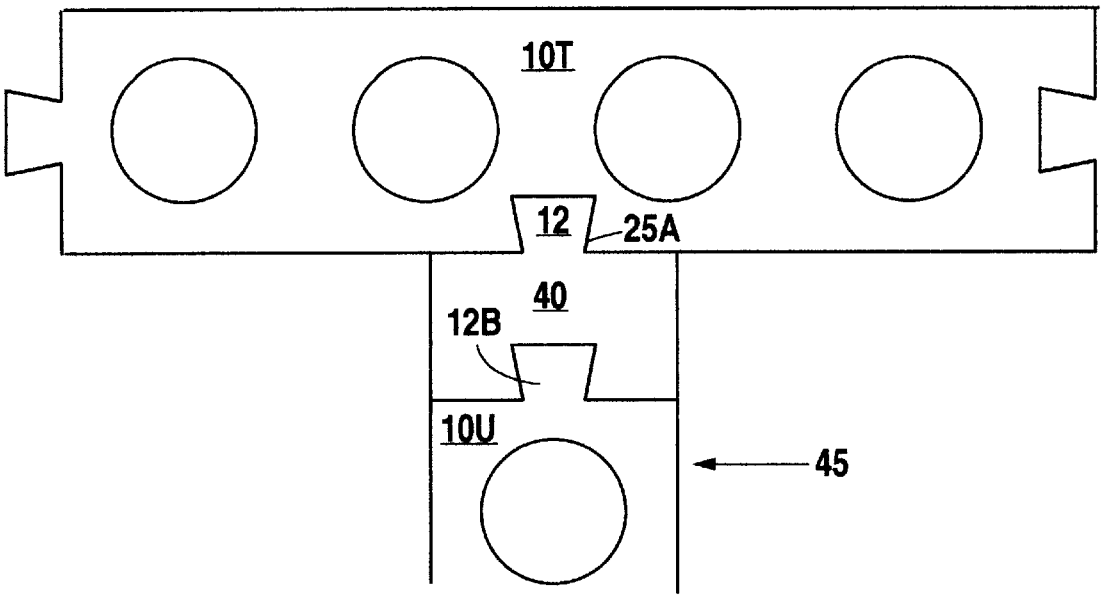
FIG. 10 is a top plan view of an extension unit connected to a main unit to form a partition wall.

The extension unit 40 has a mortise 41 and a tenon 42 and provides an extension to close gaps in a wall 7 as illustrated in FIG. 8. Preferably, the extension unit 40 has a length of approximately one inch. It may also be used to initiate a partition wall. Referring to FIG. 10, the partition wall is created by cutting a mortise 25T in the side of a unit 10T. The tenon 42 of the extension unit 40 is inserted into the mortise 25T to create a partition wall 45. A tenon of another unit, such as the tenon 12U of the unit 10U, may be inserted to extend the partition wall 45.

Figure 9:
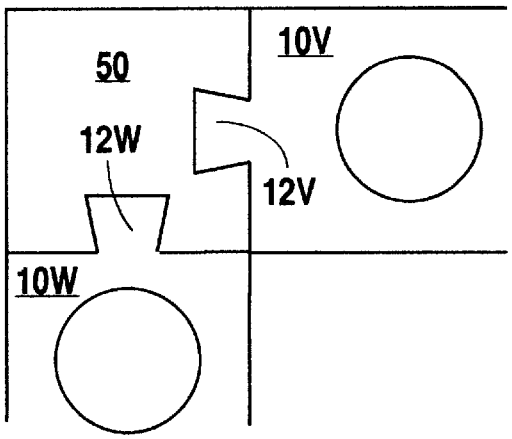
FIG. 9 is a top plan view of a corner unit in combination with two main units.

The corner unit 50 joins two wall segments. The corner unit 50 has a first mortise 51 and a second mortise 52. The corner unit 50 receives the tenon of an adjoining unit, such as the tenons 12V and 12W of respective units 10V and 10W as depicted in FIG. 9.

An angled unit 60 provides flexibility for creating the shape of the wall. The angle unit has a mortise 61 and a tenon 62. As illustrated in FIG. 7, the unit 60 allows a wall to be continued at approximately a 45 degree angle from the previous unit 23, but it should be understood that the unit 60 may be cut at various angles depending on the shape of the wall that is desired.

An ICF system 5 is depicted in FIG. 2. To construct a linear wall 7, a first main unit 10A is positioned with its length aligned with the direction of the wall 7. A hot wire cutting device is used to create a second main unit 10B that has a height H2 approximately half the height H1 of the main unit 10A. The tenon of unit 10B is inserted into the mortise of unit 10A. Next, the unit 10C have a height substantially equal to unit 10A is placed in the row. The tenon of unit 10C is inserted into the mortise of unit 10B. After creating the first row, units 10D–F are stacked on respective units 10A–C and interconnected in the same manner as units 10A–C. This creates three columns, Column A, Column B, and Column C. Column B is offset with Columns A and C to stabilize the rows. Stacking of the units 10G–P extends the height of the wall 7. After stacking the unit 10P, two units 10Q and 10S are added to Column B. Unit 10S is substantially the same height as unit 10B and levels the height of Column B with that of Column A. To complete the wall, a final unit 10R is added to Column C.

It should be understood that the height of the wall 7 is merely exemplary and that units 10 may be added or subtracted as needed. Furthermore, Columns A and B may be repeated for extending the length of the wall 7. Furthermore, units 30, 40, 50, and 60 may be added or substituted as needed. As an example, if it is desired to add a unit 40 to the Column C, the unit 40 is cut with a hot wire cutting device to a height H2 and then the tenon 42 of the extension unit 40 is inserted into the mortise 11C of the unit 10C. Subsequent units 40 having a height HI are stacked on top of the first unit 40 until the height of these units reaches the unit 10Q. Afterwards, the wall 7 is leveled by adding another unit 40 of the height H2 by inserting its tenon 42 into the mortise 11R of the unit 10R.

Once the wall 7 is erected, the wall may be braced by grouting concrete into the trapezoidal openings 17 and 19 of the unit 10. This bracing stabilizes the wall 7 for the final concrete pour. Preferably, two openings 17 and 19 per unit 10 are grouted with concrete. Referring to FIG. 2, openings 17P–S and 19P–S are grouted with concrete. The concrete extends from the units 10P–R to the units 10A–C to create trapezoidal reinforcement columns throughout the entire height of the wall 7.

To reinforce the wall 7, concrete is poured into the cavities 13A–R–16A–R of the units 10A–R. This pouring creates concrete columns that extend from the units 10P–S to the units 10A–C. Once the concrete solidifies, the wall 7 is now ready to support other structures of the building.

From the foregoing description and illustration of this invention it is apparent that various modifications may be made by reconfigurations or combinations producing similar results. It is, therefore, the desire of the applicant not to be bound by the description of this invention as contained in this specification, but be bound only by the claims as appended hereto.

I claim:

1. An insulated concrete form system, comprising:

a first unit having a first height positioned to create a first column of units, said first unit including a body, a tenon and a mortise positioned at opposing ends of said body, and at least one opening extending substantially vertically through said body for facilitating the cutting of said body into at least two smaller component bodies, whereby from each opening a mortise is formed on one component body; and a second unit coupled to said first unit having a second height unequal to said first height for creating a second column of units offset from the first column of units, said second unit including a body, a tenon and a mortise positioned at opposing ends of said body, and at least one opening extending substantially vertically through said body for facilitating the cutting of said body into at least two smaller component bodies, whereby from each opening a mortise is formed on one component body.

2. The insulated concrete form system of claim 1 wherein said first unit is a main unit, comprising:

a body;

a tenon and a mortise positioned at opposing ends of said body;

three openings extending substantially through said body for facilitating the cutting of said body into at least two smaller component bodies, whereby from each opening a mortise is formed on one component body; and four cavities for receiving reinforcing concrete extending through said body.

3. The insulated concrete form system of claim 2 wherein said second unit is an extension unit having a tenon and mortise at opposing ends wherein said extension unit has a length substantially less than said main unit.

4. The insulated concrete form system of claim 2 wherein said second unit is a substantially square-shaped corner unit having a first and second mortise positioned on adjacent sides of said corner unit.

5. The insulated concrete form system of claim 2 wherein said second unit is an angled unit having a tenon and a mortise wherein said mortise is positioned at angled relation to said tenon for coupling additional units in a non-linear relationship to said first unit.

6. An insulated concrete form unit, comprising:

a body;

a tenon and a mortise positioned at opposing ends of said body; and at least one opening extending substantially vertically through said body for facilitating the cutting of said body into at least two smaller component bodies, whereby from each opening a mortise is formed on one component body.

7. The insulated concrete form unit of claim 6 wherein said opening is substantially trapezoidal-shaped.

8. The insulated concrete form unit according to claim 6, further comprising:

at least one cavity extending through said body for receiving reinforcing concrete.

9. The insulated concrete form unit according to claim 8, wherein said cavity is larger than one-half the width of said body.

10. A method of creating an insulated concrete form wall, comprising the steps of:

positioning a first main unit including:

a body having a first height;

a tenon and a mortise positioned at opposing ends of said body; and three openings extending substantially through said body for facilitating the cutting of said body into at least two smaller component bodies, whereby from each opening a mortise is formed on one component body;

cutting a second main unit to a second height to offset its top surface with a top surface of said first unit; and coupling said first and second units together via respective mortises and tenons.

11. The method of creating an insulated concrete form wall of claim 10 further comprising the steps of:

positioning a third main unit on said first main unit to create a first column of main units; and positioning a fourth main unit on said second main unit to create a second column of main units offset from said first column of units.

12. The method of creating an insulated concrete form wall of claim 11 further comprising the step of reinforcing the wall prior to the final concrete pour by selectively grouting said openings with concrete.

13. The method of creating an insulated concrete form wall of claim 11 further comprising the step of reinforcing the wall with a final concrete pour by pouring concrete into said cavities.

14. The method of creating an insulated concrete form wall of claim 10 further comprising the step of cutting a mortise into a side of said first main unit perpendicular to said tenon and mortise for creating a partition wall.

15. The method according to claim 10, wherein the second main unit comprises a body, a tenon and a mortise positioned at opposing ends of said body, and at least one opening extending substantially vertically through said body for facilitating the cutting of said body into at least two smaller component bodies, whereby from each opening a mortise is formed on one component body.

16. The method according to claim 10, wherein the first main unit for the step of positioning a first main unit further includes four cavities extending through said body.

* * * * *